United States Patent [19]

Marsh

[11] 3,933,353

[45] Jan. 20, 1976

[54] GAME DEVICE FOR TWO OR MORE PERSONS WHICH IS USED WITH THE FEET

[76] Inventor: Charles M. Marsh, Rte. 1, Box 75, Bristol, Ind. 46507

[22] Filed: Apr. 28, 1975

[21] Appl. No.: 572,171

[52] U.S. Cl. ..... 272/70; 280/11.13 H; 273/1 R

[51] Int. Cl.[2] ..... A63B 23/04

[58] Field of Search ..... 273/70, 70.2, 1 R, 82, 273/57 B; 35/29 R, 29 C; 280/11.13 H, 12 H, 23, 11.35 R

[56] References Cited

UNITED STATES PATENTS

| | | | |
|---|---|---|---|
| 1,529,421 | 3/1925 | Dowell | 272/70 |
| 1,575,847 | 3/1926 | King et al. | 272/70 |
| 2,160,722 | 5/1939 | Cunningham | 272/70 |
| 2,538,838 | 1/1951 | Kuhnes | 272/70 |
| 2,646,282 | 7/1953 | Ringman | 272/70 |
| 2,984,497 | 5/1961 | Hagen | 280/11.35 R |

*Primary Examiner*—Paul E. Shapiro
*Assistant Examiner*—T. Brown
*Attorney, Agent, or Firm*—Oltsch & Knoblock

[57] ABSTRACT

A game device which includes a pair of rigid strip members such as planks, each carrying at least two upwardly projecting loop parts. With the strip members placed in parallel fashion upon the ground two or more players stand upon the strip members, grasping the bight of the loop parts with each hand. The players pull upwardly on the loop parts, causing the strip members to be held against the feet, and walk or shuffle the strip members across the ground.

3 Claims, 3 Drawing Figures

Fig. 1
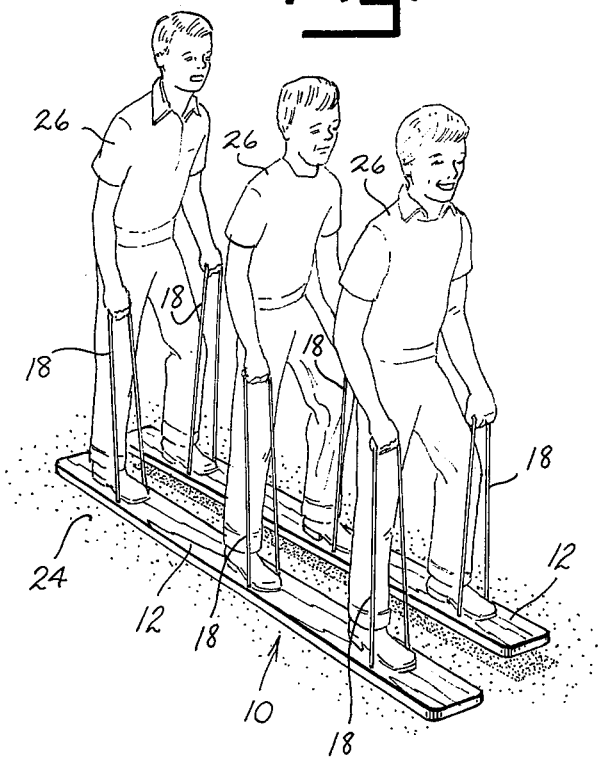
Fig. 2
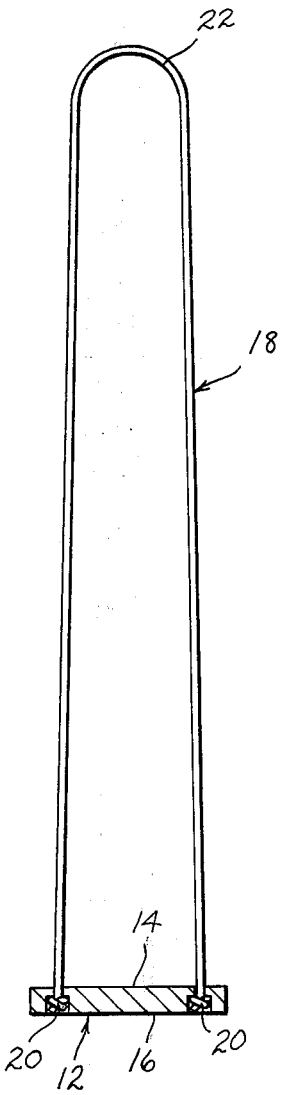
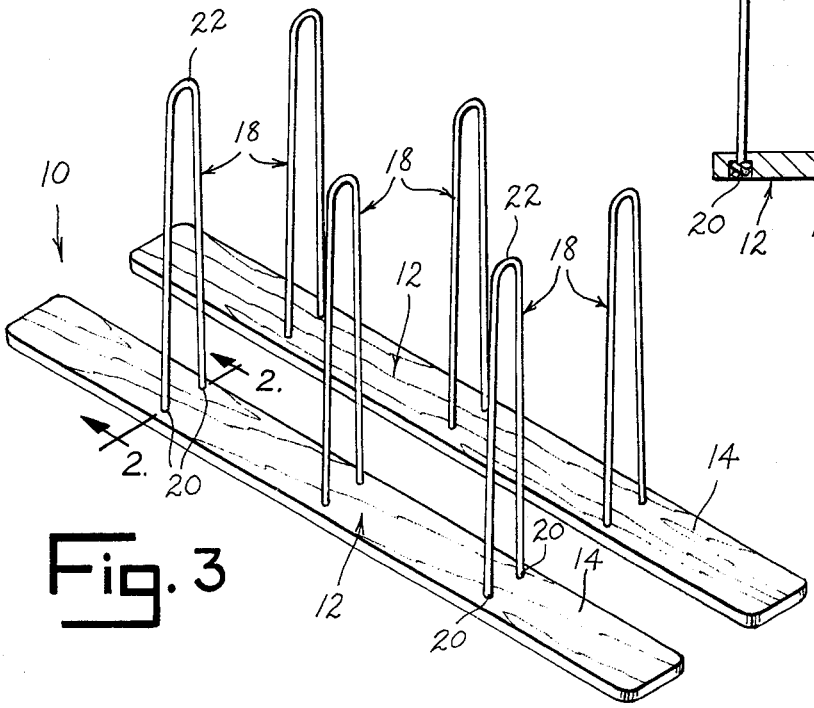
Fig. 3

GAME DEVICE FOR TWO OR MORE PERSONS WHICH IS USED WITH THE FEET

Summary of the Invention

This invention relates to a game device which can be utilized by two or more players and which has specific application to an exercise and coordination developing game used with the feet.

The game device of this invention includes a pair of rigid strip members, such as planks, having upper and lower faces. At least two loop parts are connected to each strip member with the bight portions thereof projecting from the upper face of the strip member. The loop parts are spaced apart along the longitudinal dimension of each strip member and are secured at their end parts to the strip members. With the two strip members placed parallel to one another upon the ground, two or more players stand with one foot upon each strip member. Each player then grasps the bight portion of a loop part with each hand, pulling upon the loop parts to cause the strip members to be held against the bottom of the players' feet. The players then walk in unison, causing the strip members to be shuffled across the ground.

The players of the game device of this invention, besides enjoying the game device and the exercise from its use, also develop teamwork and coordination. The strip members of the game device may be sized to accommodate two, three or more players, with the greater the number of players utilizing the game device at one time the greater the degree of teamwork and coordination required to walk the strip members across the ground. By utilizing two or more game devices, races and similar contests can be run.

Accordingly, it is an object of this invention to provide a game device which is used by the feet and played by two or more players and which develops teamwork and coordination among the players.

It is another object of this invention to provide a game device constituting strip members, such as planks, upon which two or more players stand and through connected loop parts shuffle or walk the strip members across the ground.

Still another object of this invention is to provide a game device which can be used by two or more players to traverse the ground in a coordination and teamwork building exercise.

Still another object of this invention is to provide a game device which is used with the feet and played by two or more players and which is of economical construction.

Other objects of this invention will become apparent upon a reading of the invention's description.

Brief Description of the Drawings

A preferred embodiment of this invention has been chosen for purposes of illustration and description wherein:

FIG. 1 is a perspective view of the game device of this invention shown being used by three players.

FIG. 2 is a cross sectional view of one of the strip members of the game device taken along line 2—2 of FIG. 3.

FIG. 3 is a perspective view of the component parts of the game device of FIG. 1 shown without the players.

Description of the Preferred Embodiment

The preferred embodiment is not intended to be exhaustive or to limit the invention to the precise form disclosed. It is chosen and described in order to best explain the principles of the invention and its application and practical use to thereby enable others skilled in the art to best utilize the invention.

Game device 10 shown pictorially in FIG. 3 includes two strip members 12 which are of equal length and width. Strip members 12 may be formed of wood, a plastic material, fiberglass or of similar material so as to form a rigid, plank-like configuration. Each strip member 12 has an upper face 14 and a lower face 16. A plurality of loop parts 18 are connected to each strap member 12. Each loop part 18 is secured at its ends 20 to its connecting strip member 12 with its bight 22 projecting from upper face 14 of the strip member. End portions 20 of each loop part 18 are aligned transversely relative to the connecting strip member and are spaced apart so as to accommodate the insertion of the foot of a player between the end portions. In the illustrated embodiment there are three loop parts 18 connected to each strip member 12, with the spacing between each loop part and the ends of connecting strip member 12 being sufficient to accommodate three standing players, as shown in FIG. 1. Each loop part 18 is preferably of a rope or cord construction so as to have a flexible characteristic. Loop parts 18 are illustrated in FIG. 3 in their extended form for purposes of illustration only. It is to be understood, however, that in some embodiments of this invention each loop part 18 may be formed of resilient material which can be bent or molded into a free upstanding form projecting upwardly from upper face 14 of its connecting strip member in a spaced relationship relative to each other.

In a working embodiment of the game device, each strip member 12 is sixty inches long, with the three loop parts 18 connected to each strip member being spaced 15 inches apart, beginning 15 inches from one end of the strip member. The height of each loop part 18 in its extended position as measured from the upper face 14 of the connecting strip member is approximately 29 inches, and the width of each strip member is approximately 5¼ inches. It is to be understood that the length of strip members 12 and the number of loop parts 18 can vary, depending upon the number of players each strip member is designed to accommodate. Additionally, the length of loop parts 18 as measured from connecting strip member upper face 14 to the bight 22 of the loop member can vary and can even be made so as to be adjustable, depending upon whether children or adults are utilizing the game device.

To play the game device, strip members 12 are placed upon ground 24, slightly spaced apart and in parallel fashion. Participants 26 each place one foot upon upper face 14 of each strip member 12 between end portions 20 of a loop part 18. Each participant then grasps the bights 22 of the loop parts between which his feet are placed with his hands and pulls upwardly on the loop parts to cause strip members 12 to be drawn against his feet. The participants then walk or shuffle the strip members 12 along the ground in coordinated fashion. Both backward and forward movement as well as parallel hill climbing can be accomplished upon strip members 12. To vary the use of the game device, one or more participants 26 can be turned so as to face one another during the walking or shuffling of strip members 12.

It is to be understood that the invention is not to be limited to the details above given but may be modified within the scope of the appended claims.

What I claim is:

1. A game for two or more players and used with the feet comprising a pair of rigid strip members, each member having upper and lower faces, first and second loop parts connected to each member between the ends of the member, each loop part having two end portions and an intermediate bight portion and bein secured to its connecting member at its end portions with its bight portion projecting from the upper face of the member, the end portions of each loop part being spaced apart along a line extending transversely of its connecting member, said strip members each being of a width to accommodate a players foot and being of a length to allow at least two players to stand adjacently thereon, each said transverse spacing of said end portions being of a distance to accommodate a players foot therebetween and being of such longitudinal spacing such that when said members are placed side by side upon the ground generally paralleling one another one player may stand with one foot upon each member upper face positioned between the end portions of a said loop part with a hand gripping the bight portion of the loop part and a second player may stand next to said one player with one foot upon each member upper face positioned between the end portions of another loop part with a hand gripping the bight portion of the loop part to allow said players to walk in unison causing a shuffling motion of said members over the ground while holding said members against their feet by pulling upwardly on said loop parts.

2. The game device of claim 1 wherein there are three loop parts connected to each member to accommodate three players, each loop part being spaced from another loop part and the ends of its connecting strip member.

3. The game device of claim 1 wherein said loop parts are of a flexible cord-like construction.

* * * * *